US006682375B1

(12) United States Patent
Dickson

(10) Patent No.: US 6,682,375 B1
(45) Date of Patent: Jan. 27, 2004

(54) TRIM SYSTEM FOR OUTBOARD MOTOR-DRIVEN WATERCRAFT

(76) Inventor: Trevor Alan Dickson, 238 Kenmure Rd., Dunedin (NZ)

( * ) Notice: Subject to any disclaimer, the term of this patent is extended or adjusted under 35 U.S.C. 154(b) by 0 days.

(21) Appl. No.: 10/255,514

(22) Filed: Sep. 26, 2002

(51) Int. Cl.[7] ..... B63H 5/125
(52) U.S. Cl. ..... 440/53
(58) Field of Search ..... 440/53, 61 T, 62, 440/63; 114/145 A; 248/640, 641, 642, 643, 617

(56) References Cited

U.S. PATENT DOCUMENTS

| | | | | |
|---|---|---|---|---|
| 2,886,462 A | * | 5/1959 | Jagiel | 248/617 |
| 2,954,192 A | * | 9/1960 | Baird | 248/641 |
| 3,965,838 A | | 6/1976 | Uht | |
| 4,013,249 A | | 3/1977 | Meyer et al. | |
| 4,239,172 A | | 12/1980 | Spitzmesser | |
| 4,306,703 A | | 12/1981 | Finze | |
| 4,355,986 A | | 10/1982 | Stevens | |
| 4,367,860 A | | 1/1983 | Strang | |
| 4,565,528 A | | 1/1986 | Nakase | |
| 4,872,857 A | | 10/1989 | Newman et al. | |
| 4,931,025 A | | 6/1990 | Torigai et al. | |
| 5,118,315 A | | 6/1992 | Funami et al. | |
| 5,493,990 A | | 2/1996 | Dyer | |
| 5,711,241 A | | 1/1998 | Dyer | |
| 6,007,391 A | | 12/1999 | Eilert | |
| 6,149,476 A | | 11/2000 | Eilert | |
| 6,308,651 B2 | | 10/2001 | McKenney et al. | |

* cited by examiner

*Primary Examiner*—S. Joseph Morano
*Assistant Examiner*—Lars A. Olson
(74) *Attorney, Agent, or Firm*—Kathleen M. Harleston; Harleston Law Firm LLC

(57) ABSTRACT

An automatically adjusting trim system for a watercraft having an outboard motor mounted on its stern, includes:

(a) a pivotable mounting mechanism connecting the watercraft and the outboard motor, a shaft of the motor being rotatable about a trim axis, the trim axis being horizontal and disposed perpendicular to a longitudinal axis of the watercraft, the pivotable mounting mechanism including a movable swing arm; and (b) a spring mechanism including at least one spring, a portion of the swing arm of the pivotable mounting mechanism being pivotable against the spring;

wherein, when the motor is powered, the thrust of the motor automatically pushes the swing arm, which pushes in the spring, which changes position of the motor, lifting the stern, driving a bow of the watercraft down, and moving the watercraft into a planing position. Also included is a method for improving planing performance by an outboard motor-driven watercraft.

17 Claims, 6 Drawing Sheets

TRIM SYSTEM FOR OUTBOARD MOTOR-DRIVEN WATERCRAFT

CROSS REFERENCE TO RELATED DOCUMENT

This invention is described in New Zealand Provisional Patent Application No. 40-016, filed in March, 2002.

BACKGROUND OF THE INVENTION

1. Technical Field

The present invention relates to a trim system for a watercraft with a propeller driven by an outboard motor, and more particularly to an automatically adjusting trim system for optimizing performance of a small, outboard motor-driven watercraft.

2. Background Information

Ordinarily, outboard motors are mounted on the transom of a watercraft by means of a clamping bracket that is connected to the transom. A swivel bracket is often pivotally connected to the clamping bracket, and the outboard motor is mounted on the swivel bracket. The swivel movement permits certain adjustments of the outboard motor. The outboard motor itself is supported by the swivel bracket for steering movement about a generally vertically extending steering axis.

On small, outboard motor-driven watercraft, it is a common practice to include a series of spaced-apart holes in the clamping bracket for receiving a trim pin. This trim pin position engages with the swivel bracket and can be manually adjusted before operation of the watercraft, to set the trim condition of the motor, depending on the pair of holes in which the pin is received. Other types of trim-related devices include levers or ratchets for rotating and holding the outboard in different positions, but these require manual operation and do not respond to the torque "felt" by the watercraft.

Larger watercraft often have a means of adjusting the trim during operation of the watercraft, so as to accommodate the particular running conditions and improve the performance of the watercraft. Normally, trim adjustment is provided by a hydraulic trim motor that is fixed between the huff and the outboard motor, which allows the outboard motor to be moved to the desired trim position.

In order to quickly bring a watercraft up out-of-the-hole from a standstill position to an on-plane condition, it is a normal practice to trim-down the motor, lower the bow, and raise the stern of the watercraft. A disadvantage of using a hydraulic trim motor to achieve this condition is the weight, complication, and expense of the hydraulic trim system. Many smaller watercraft do not have a well-performing trim system.

Hydrofoils can also facilitate watercraft planing performance by generating lift, which forces the stern of the watercraft up and the bow down. A disadvantage of hydrofoil systems is that higher watercraft speeds or much higher motor speeds are required to generate sufficient lift with the hydrofoil to place the watercraft on-plane.

The present invention provides an automatically adjusting, yet simple, trim system for an outboard motor-driven watercraft that does not have these disadvantages, and provides the public with a useful alternative. It is a watercraft trim system for guiding rotation of a propeller mounted to the watercraft. Propeller rotation in a forward drive direction causes a thrust on the watercraft, which moves the watercraft in a forward direction. Thrust produces a torque reaction from the watercraft, which tends to raise its bow. With the trim axis placed in a planing position, the watercraft adopts a planing attitude. The trim system of the present invention stabilizes the watercraft and optimizes its performance in the water.

BRIEF SUMMARY OF THE INVENTION

The present invention is an automatically adjusting trim system for a watercraft having an outboard motor mounted on its stern, including:

(a) a pivotable mounting mechanism connecting the watercraft and the outboard motor, a shaft of the motor being rotatable about a trim axis, the trim axis being horizontal and disposed perpendicular to a longitudinal axis of the watercraft, the pivotable mounting mechanism comprising a movable swing arm; and (b) a spring mechanism comprising at least one spring, a portion of the swing arm of the pivotable mounting mechanism being pivotable against the spring;

wherein, when the motor is powered, the thrust of the motor automatically pushes the swing arm, which pushes in the spring, which changes position of the motor, lifting the stern, driving a bow of the watercraft down, and moving the watercraft into a planing position. Preferably, the spring mechanism of the trim system includes two matching compression spring each extending between a trim bracket of the pivotable mounting mechanism and a downward extending bar of the swing arm, the trim bracket being mountable to the transom of a watercraft.

Also included herein is a method for enabling an outboard motor-driven watercraft with a propeller to attain and maintain a planing attitude, including the steps of:

(a) in a first position wherein the propeller provides no thrust, pre-loading two matching, parallel, of a spring mechanism of a trim system, the springs extending between a lower portion of a swing arm and a middle bracket section of a trim bracket of the trim system, so as to bias the outboard motor in a forward direction the lower portion of the swing arm being restrained by a stop plate, the middle bracket section being removably mounted on the transom of the watercraft; and (b) applying thrust to the outboard motor, creating a torque reaction on the watercraft, wherein the spring mechanism automatically causes the outboard motor to rotate forward about an axis of the trim system to a second position attaining a planing position.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
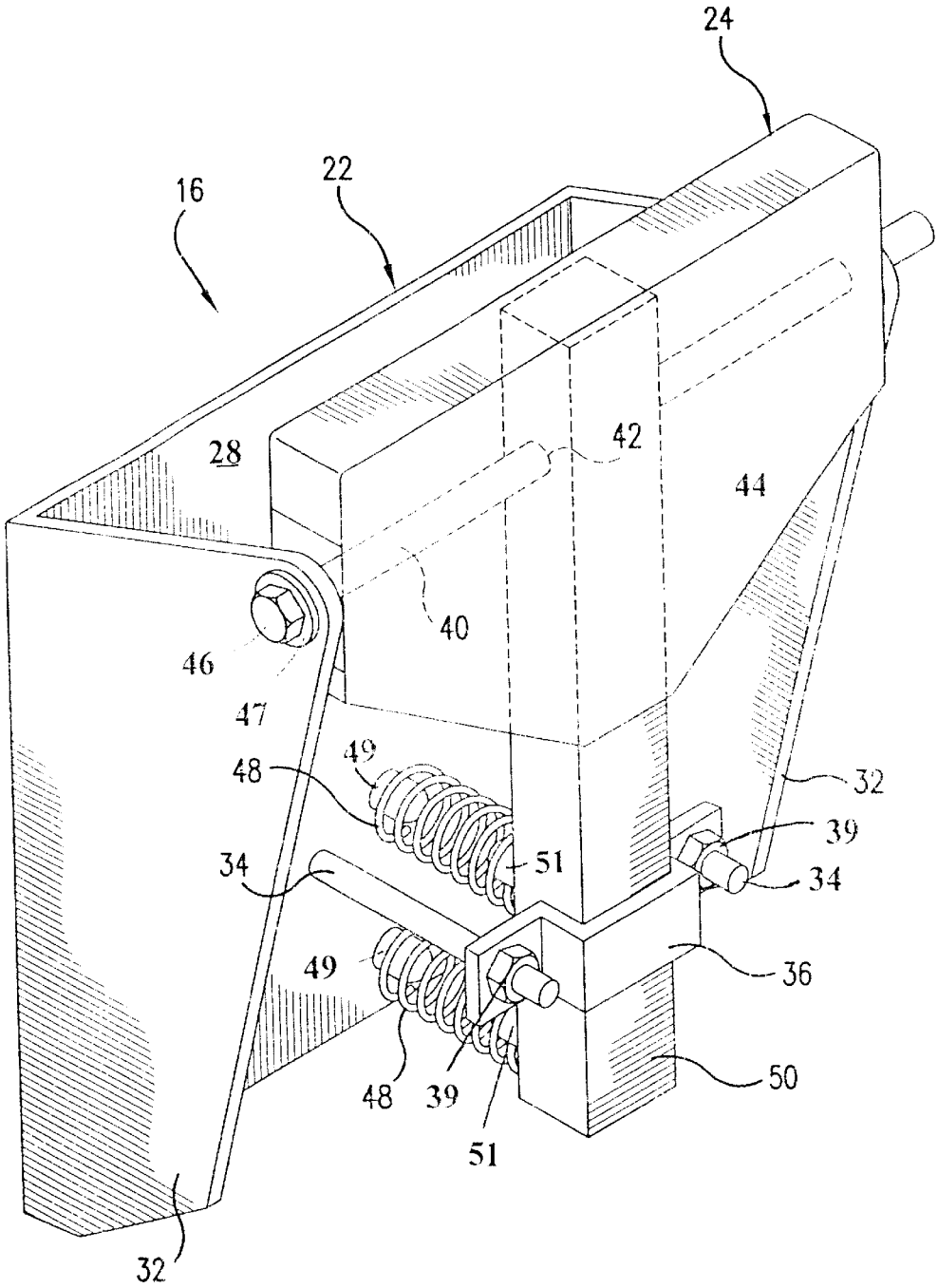
FIG. 1 is a perspective view of a trim system according to the present invention.

In the following description, like reference characters designate like or corresponding parts throughout the several views. Also, in the following description, it is to be understood that such terms as "front," "rear," "within," and the like are words of convenience and are not to be construed as limiting terms. Referring in more detail to the drawings, the invention will now be described.

Referring to FIG. 1, a trim system according to the present invention, generally referred to as 10, for use on an outboard motor-driven watercraft 12 with a conventional transom 14 includes a pivotable mounting mechanism 16, and a spring mechanism 26 for resiliently urging a propeller of the watercraft to rotate towards a planing position. The trim system 10 is intended for use on a relatively small watercraft. By "small watercraft" is meant a marine vessel less than about 18 feet in length or weighing less than about 800 pounds. The present invention is preferably used on a motor boat between about four and ten feet in length, and weighing less than about 500 pounds, which accommodates one to three people. Suitable watercraft also include dinghies with outboard motors, or motorized toy boats, each with a small motor and propeller mounted on the stern. Surprisingly, the present trim system 10 can easily be removed and re-installed on a second watercraft, then back to the first watercraft, as desired.

Figure 2:
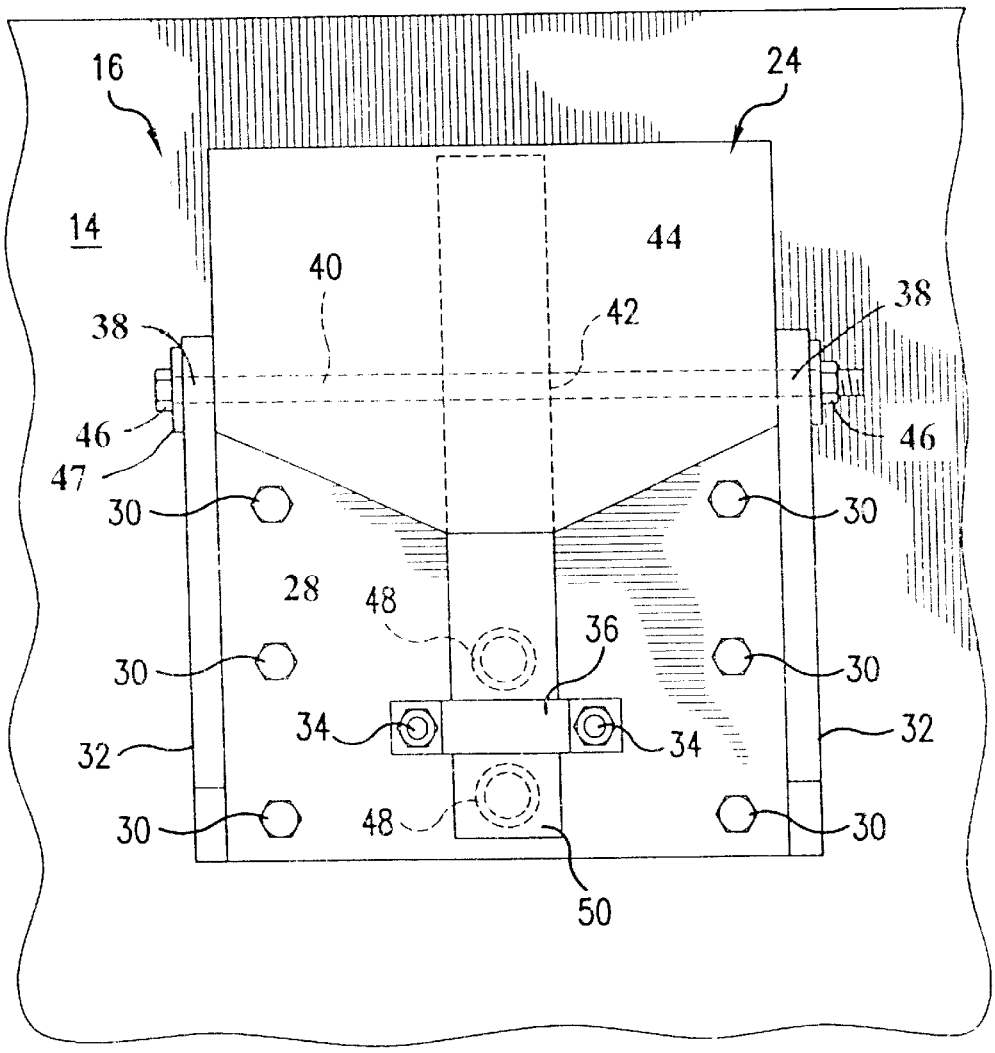
FIG. 2 is a front elevational view of the trim system according to FIG. 1.

Referring to FIGS. 1 and 2, the pivotable mounting mechanism 16 comprises a trim bracket 22, and a movable swing arm 24 mounted on the trim bracket 22. The spring mechanism 26 is located between the trim bracket 22 and a base bar of the swing arm 24. Regarding the first element, the trim bracket 22 comprises a substantially planar middle bracket section 28, which is mountable on the transom 14 of the watercraft (see FIG. 2), and two matching side arms 32 extending out from opposite sides of the middle bracket section 28. In a preferred embodiment, the trim bracket 22 is mounted on the outside of the transom 14 using mounting bolts 30 extending through holes along the opposite sides of the trim bracket, as shown in FIG. 2. (The mounting bolts preferably do not extend through the transom.) As shown in FIG. 1, the two matching side arms 32 extend in a generally perpendicular direction from opposite sides of the middle bracket section 28. Two same-sized connecting bars 34 also extend outwardly and in a generally perpendicular direction from a bottom portion of the middle bracket section 28.

Figure 3:
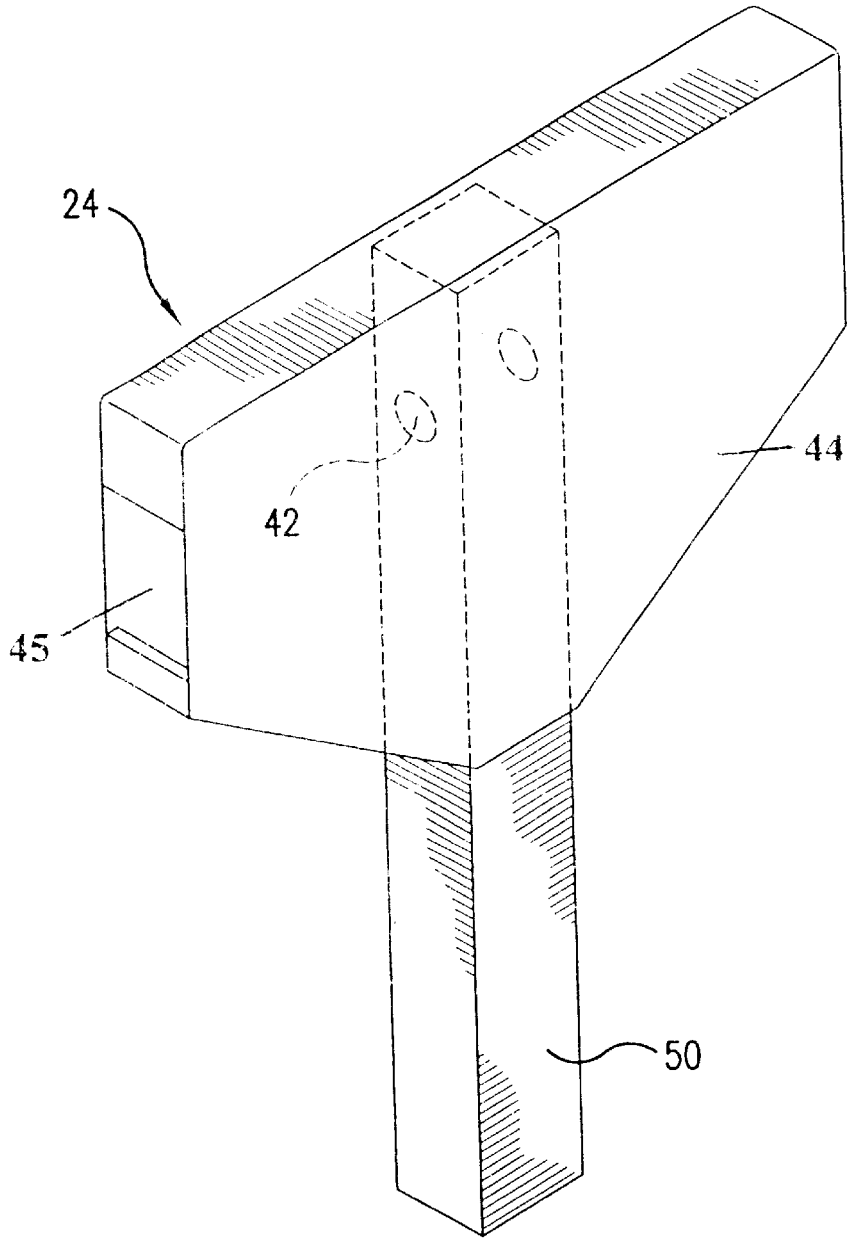
FIG. 3 is a perspective view of a swing arm of a trim system according to the present invention.

Regarding the second element, the generally T-shaped swing arm 24, which is shown in FIGS. 1 through 3, includes an upper, generally horizontal portion 44 and a generally vertical bar 50, which is perpendicular to and below the upper portion 44. The swing arm bar 50 extends into a central area of the upper portion 44. The T-shaped swing arm 24 comprises a hole 42, which extends through an upper portion of the bar 50 of the swing arm 24 in a generally horizontal direction. Swing arm bolt 40 extends through opposite openings 45 in the upper portion 44 (see FIG. 3) and through the swing arm hole 42. The opposite ends of swing arm bolt 40 extend through corresponding holes 38 in the matching bracket side arms 32 and are fastened, preferably by a lock nut 46 and washer 47 at each end of the swing arm bolt, as shown in FIGS. 1 and 2. The swing arm 24, particularly the lower portion of the bar 50, swings back and forth on swing arm bolt 40. The pivot point at bolt 40 is on the same plane, then, as the swing arm 24.

Regarding the third element, the spring mechanism 26 for resiliently urging the watercraft's propeller to rotate towards a planing position comprises two same-sized compression springs 48, as shown in FIG. 1. The springs 48 extend between the middle bracket section 28, and the bar 50 of the generally T-shaped swing arm 24. The springs 48 are substantially parallel to one another, as shown in FIG. 1. It has been found herein that two springs, one lying below and parallel to the other, are necessary and sufficient to convey the desired advantage. Each spring is most preferably made of a non-rusting stainless steel and supports a weight of 1000 kilograms. (Generally, a more powerful motor requires a stronger spring.) The springs are most preferably about an inch or two long and between about ¼ inch and one inch wide. The ends of the springs 48 are coiled around short stops 49, 51, which extend outwardly from the middle bracket section 48 and the inside face of the swing arm bar 50, respectively. Two bracket spring stops 49 extend from the middle bracket section 48 toward corresponding bar spring stops 51, which extend from the swing arm bar 50. The stops 49, 51 hold the springs 48 in place, regardless of whether the springs are being compressed. The stops 49, 51 are preferably welded to the trim bracket 22 or the swing arm bar 50. The springs are preferably not coiled around connecting rods or bolts. It has been found that such bolts or rods are prone to shear or snap off with stress. A bolt down the center of a spring 48 that shears during operation can cause a watercraft to flip over. The present invention does not have this problem, since there are no such bolts within the springs. Also, even with the springs 48 in place, the outboard motor can still be tilted up as usual (to work on the propeller, unsnag debris from the propeller on the water, etc.).

Continuing with FIGS. 1 and 2, a central portion of a stop plate 36 fits closely around a lower portion of the movable swing arm bar 50. Holes on opposite ends of the stop plate 36 fit over the free ends of the connecting bars 34, which extend next to the movable swing arm bar 50. The stop plate 36 is fastened onto the connecting bars 34, preferably by stop plate lock nuts 39. The stop plate 36 prevents the swing arm bar 50 from flipping up. There are several (most preferably five to seven) inches of "give" between the stop plate 36 and the swing arm bar 50. It is because of the "give" in the spring mechanism, which is provided by the automatically adjusting springs 48 (which are not restricted by central bolts), and between the stop plate and the swing arm bar, that the trim system 10 responds automatically and surprisingly well, allowing the boat to attain/maintain a planing attitude.

In use, when the swing arm bar 50 swings forward, the springs 48 are compressed between the swing arm bar 50 and the trim bracket 22 on the transom. The spring mechanism 26 restrains rotation of the trim bracket 24.

Figure 4:
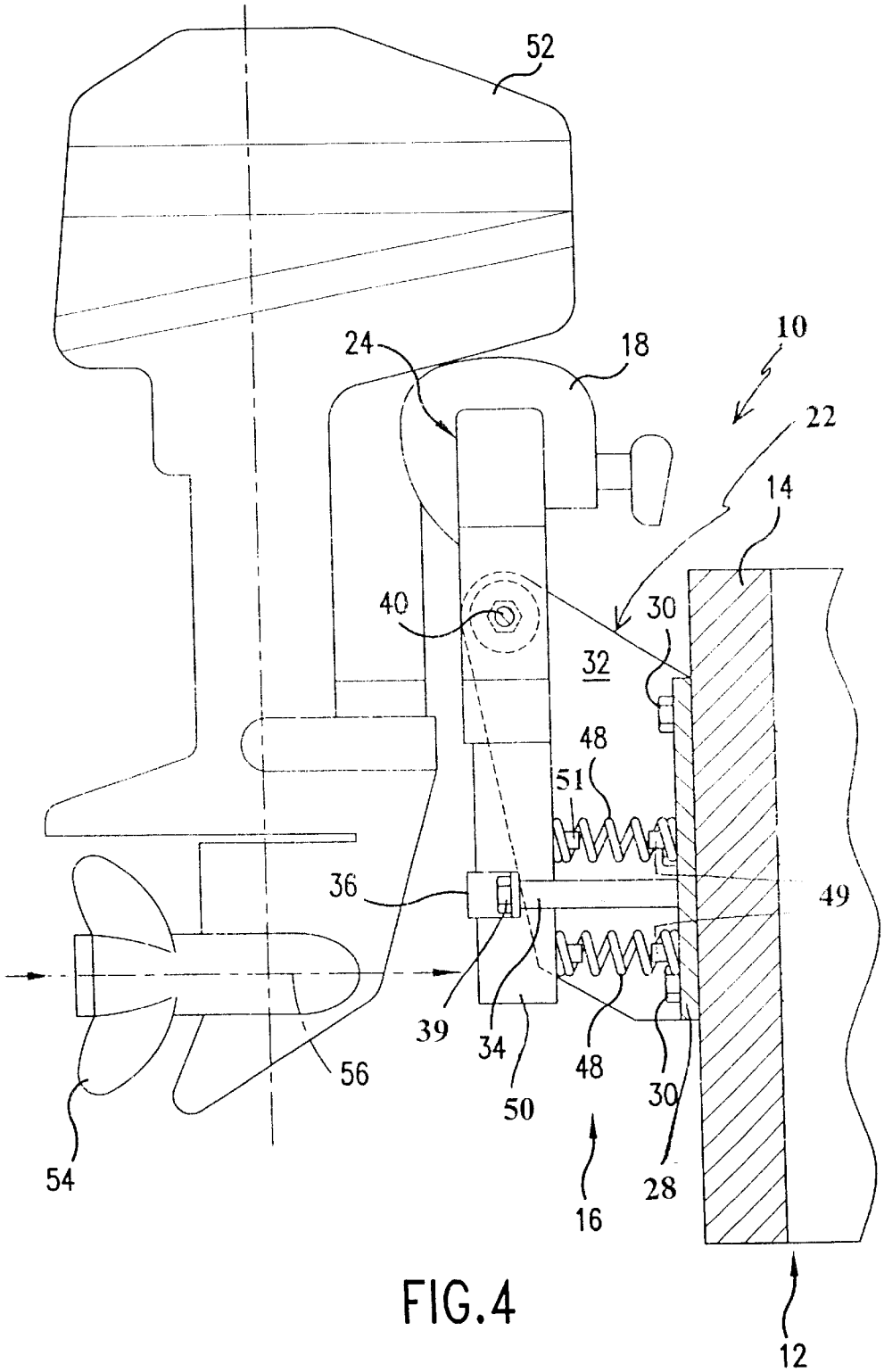
FIG. 4 is a side elevational view of the rear of a watercraft with a trim system according to the present invention, showing an outboard motor in a first position where no thrust is applied to the motor.
Figure 5:
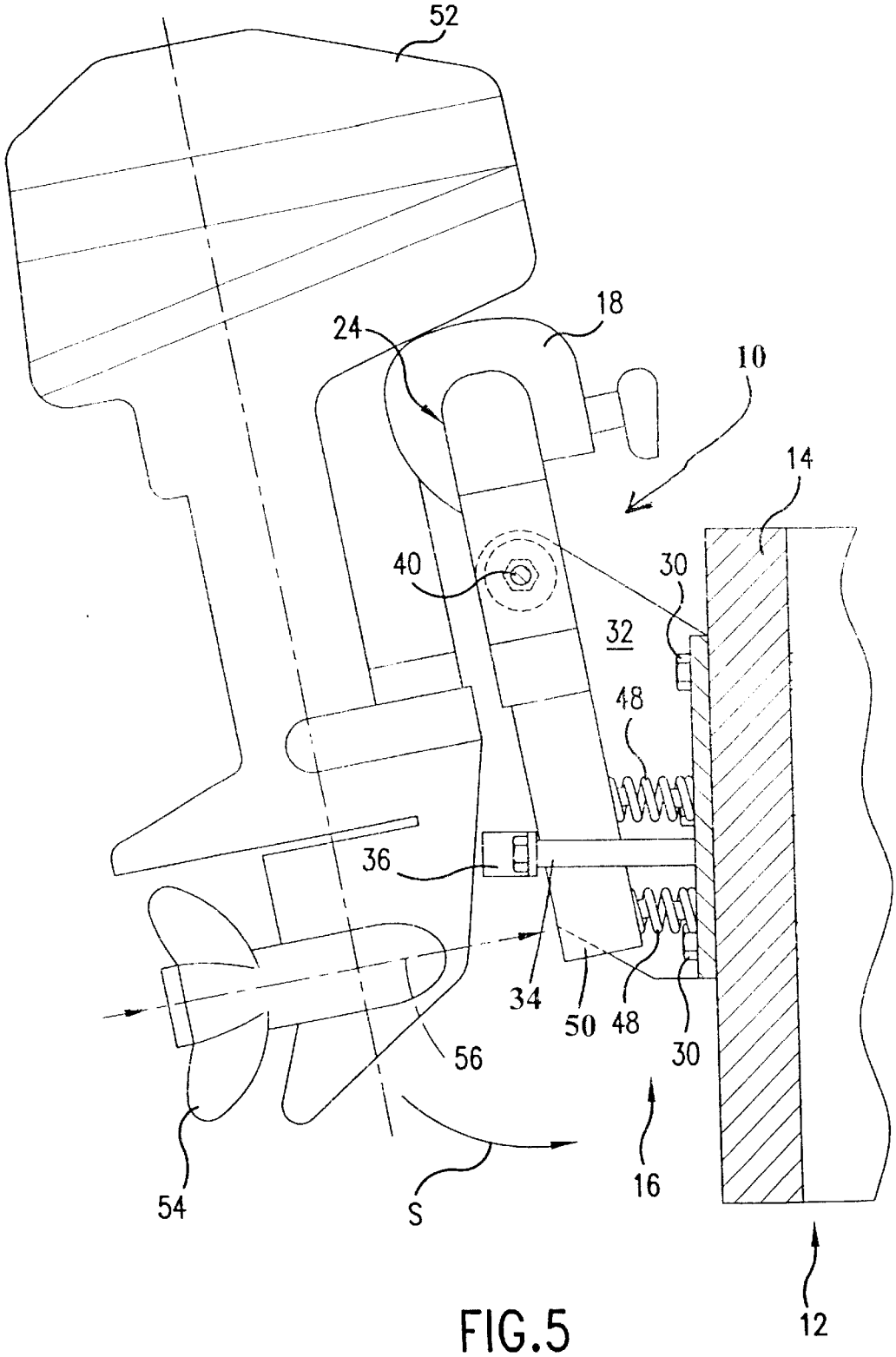
FIG. 5 is a side elevational view of the rear of a watercraft with a trim system according to the present invention, showing an outboard motor in a second position where thrust is applied to the motor and the torque reaction of the watercraft is high.
Figure 6:
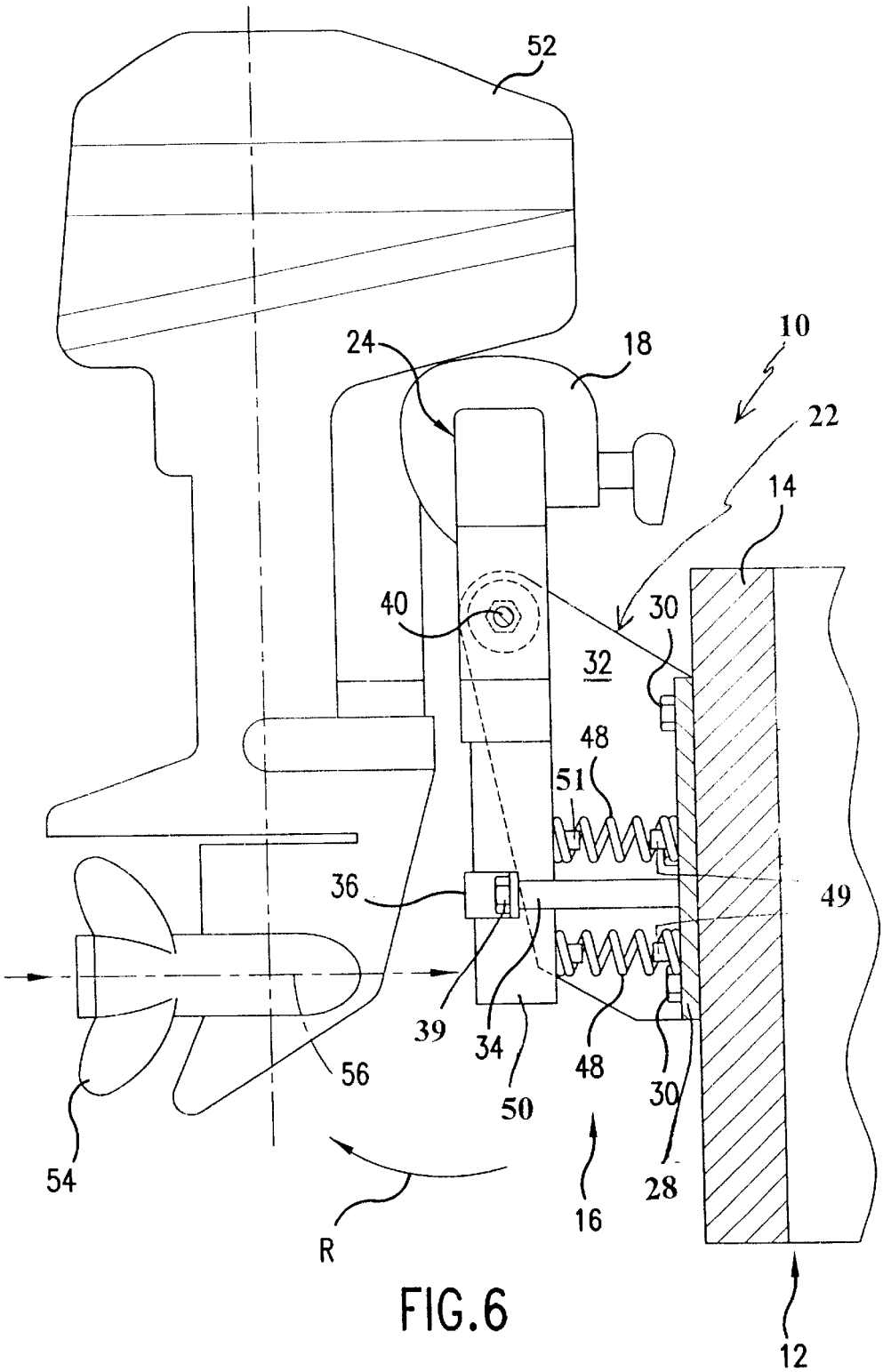
FIG. 6 is a side elevational view of the rear of a watercraft with a trim system according to the present invention, showing an outboard motor in a third position where thrust is applied to the motor and the torque reaction of the watercraft is low.

Turning to FIGS. 4 through 6, the watercraft's outboard motor 52, which has a conventional propeller 54 at its lower end, is movably mounted to a motor bracket 20, which is mounted on an upper part of the swing arm 24 of the trim system 10. The trim bracket 22 is mounted on the transom 14 between the stern of the watercraft 12 and the outboard motor 52 via mounting bolts 30. The swing arm 24 is movably mounted on the swing arm bolt 40 between the two matching side arms 32 of the trim bracket 22. The stop plate 36 extends in a generally horizontal direction across the generally vertical swing arm bar 50. The opposite ends of the stop plate 36 are bolted to matching connecting bars 34. The connecting bars 34 extend out in a generally perpendicular direction from the middle section 28 of the trim bracket 22 on either side of the swing arm bar 50. A set of matching springs 48 extend between the swing arm bar 50 and the middle bracket section 28 of the trim bracket 22. The ends of the springs 48 are coiled around stops 49, 51 on the middle bracket section 28 and the swing arm bar 50, respectively.

Continuing with FIGS. 4–6, the shaft of the motor and the propeller 54 are rotatable about an axis 56. The propeller axis 56 is generally horizontal and disposed perpendicular to a longitudinal axis of the watercraft 12. As the propeller 54 rotates about the propeller axis 56, a thrust on the outboard motor 52 in the direction the watercraft is going results, as indicated by the arrows in FIGS. 5–6. This moves the watercraft in a forward direction. The swing arm 24 pivots about the trim axis, which is generally horizontal and perpendicular to the longitudinal centerline of the watercraft 12.

FIG. 4 illustrates the outboard motor 52 in an initial position where it remains while the propeller 54 provides no thrust, with the watercraft 12 low in the water. The boat is idle. FIG. 5 shows the outboard motor 52 in a second position where thrust is applied to the motor and the torque reaction of the watercraft 12 is high. The force of the thrust is pivoting under the boat 12 and the spring mechanism 26 is compensating to put the boat in a planing position. FIG. 6 shows the outboard motor 52 returned to its initial planing position (see FIG. 4).

When the trim system 10 is in use, the spring mechanism 26 restrains the rotation of the pivotable mounting mechanism 16. In the initial state, the spring mechanism 26 is pre-loaded to the planing position. The springs 48 of the spring mechanism 26 are restrained by the stop plate 36 connected to the connecting bars 34. A first end of each spring 48 acts against the middle bracket section 28. The second, opposite end of each spring 48 acts against the lower portion of the swing arm bar 50 of the swing arm 24.

When starting from the initial position (FIG. 4) with the hull of the watercraft 12 low in the water, there is a large skin friction drag on the hull, requiring a large thrust to move the watercraft 12 forward. When the torque reaction of the watercraft 12 to this thrust is high, the watercraft 12 acts to compress the springs 48 of the spring mechanism 26. The stern of the watercraft is forced up, which brings the bow down. The outboard motor 52 then rotates in direction S about the trim axis to a position as shown in FIG. 5. This rotation of the outboard motor 52 thus automatically adjusts the trim of the watercraft 12 to compensate for the torque reaction, enabling it to maintain a planing attitude (more bow-down stern-up attitude than otherwise possible) and to start planing more quickly.

As the watercraft 12 then lifts up in the water to start planing the skin friction drag on the hull is reduced, thereby reducing the torque reaction of the watercraft 12. As shown in FIG. 6, with the reduced torque reaction the spring mechanism 26 tends to rotate the outboard motor 52 in the forward direction R and the watercraft 12 is set in a planing attitude. In this planing position, the springs 48 of the spring mechanism 26 are in an intermediate state between full extension (FIG. 4) and full compression (FIG. 5).

Also included herein is a method for improving planing performance by an outboard motor-driven watercraft 12 with a propeller, including the steps of: rotating the propeller of the watercraft in a forward drive direction so as to cause a thrust on the watercraft and move the watercraft in a forward direction; automatically pivoting a trim system of the watercraft, causing a stern of the watercraft to lift, which lowers a bow of the watercraft, and forces the watercraft to a planing position.

Generally, the changing angle of the motor 52 drives the bow down and lifts the stern up, so the boat reaches a planing attitude more quickly. Power thrust in a forward direction causes the springs 48 to compress, changing the angle of the motor. Once on the plane, the springs 48 extend back to their original planing position. Reaching a planing attitude as quickly as possible and maintaining a planing attitude translates to a better performing, responsive watercraft.

Also included in the present invention is a method for enabling a outboard motor-driven watercraft 12 having a propeller 54 to maintain a planing attitude. The method includes the following steps:

(a) in a first position (FIG. 4) wherein the propeller provides no thrust, pre-loading two matching, parallel springs of a spring mechanism of a trim system, the springs extending between a lower portion of a swing arm and a middle bracket section of a trim bracket of the trim system, so as to bias the outboard motor in a forward direction, the lower portion of the swing arm being restrained by a stop plate, the middle bracket section being removably mounted on the transom of the watercraft;

(b) applying thrust to the outboard motor, creating a torque reaction on the watercraft, wherein the spring mechanism automatically causes the outboard motor to rotate forward about an axis of the trim system to a second position (see FIG. 5), attaining a planing position.

In step (a), opposite ends of the stop plate 36 are affixed to connecting bars 34, the connecting bars 34 extending in a generally perpendicular direction from the middle bracket section 28. In step (b), the springs 48 of the spring mechanism 26 are compressed between the lower portion of the swing arm 24 and the middle bracket section 28.

From the foregoing it can be realized that the described device of the present invention may be easily and conveniently utilized as a trim system for a watercraft. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 trim system
12 watercraft
14 transom
16 pivotable mounting mechanism
18 motor bracket
22 trim bracket
24 swing arm
26 spring mechanism
28 middle bracket section
30 mounting bolts
32 bracket side arms
34 connecting bar
36 stop plate
38 bracket swing arm bolt hole
39 stop plate nuts
40 swing arm bolt
42 swing arm bolt hole
44 upper portion of swing arm
45 upper portion bolt hole
46 lock nut
47 washer
48 spring
49 bracket spring stops
50 bar of swing arm
51 bar spring stops
52 outboard motor
54 propeller
56 propeller axis

What is claimed is:

1. An automatically adjusting trim system for a watercraft having an outboard motor mounted on its stern, the trim system comprising:

(a) a pivotable mounting mechanism connecting the watercraft and the outboard motor, a shaft of the motor being rotatable about a trim axis, the trim axis being horizontal and disposed perpendicular to a longitudinal axis of the watercraft, the pivotable mounting mechanism comprising a movable swing arm; and (b) a sprig mechanism comprising at least one spring, a portion of the swing arm of the pivotable mounting mechanism being pivotable against the spring;

wherein, when the motor is powered, the thrust of the motor automatically pushes the swing arm, which pushes in the spring, which changes position of the motor, lifting the stern, driving a bow of the watercraft down, and moving the watercraft into a planing position; and wherein a trim brake comprises a substantially planar middle bracket section, which is mountable on the transom of the watercraft, and two matching side arms, which extend in a generally perpendicular direction from opposite sides of the middle bracket section.

2. A trim system according to claim 1, wherein the pivotable mounting mechanism comprises connecting means attachable to the transom of the watercraft.

3. A trim system according to claim 1, wherein the spring mechanism comprises two same-sized compression springs, which are substantially parallel to one another.

4. An automatically adjusting trim system, for a watercraft having an outboard motor mounted on its stern the trim system comprising:

(a) a pivotable mounting mechanism connecting the watercraft and the outboard motor, a shaft of the motor being rotatable about a trim axis, the trim axis being horizontal and disposed perpendicular to a longitudinal axis of the watercraft, the pivotable mounting mechanism comprising a movable swing arm; and (b) a spring mechanism comprising at least one spring, a portion of the swing arm of the pivotable mounting mechanism being pivotable against the spring;

wherein, when the motor is powered, the thrust of the motor automatically pushes the swing arm, which pushes in the spring, which changes position of the motor, lifting the stern, driving a bow of the watercraft down, and moving the watercraft into a planing position; and wherein the spring mechanism comprises two matching compression springs, each compression spring extending between a trim bracket of the pivotable mounting mechanism and a downward extending bar of the swing arm, the trim bracket being mountable to the transom of the watercraft.

5. A trim system according to claim 4, wherein no rods or bolts extend within the springs.

6. An automatically adjusting trim system, for a watercraft having an outboard motor mounted on its stern, the trim system comprising;

(a) a pivotable mounting mechanism connecting the watercraft and the outboard motor, a shaft of the motor being rotatable about a trim axis, the trim axis being horizontal and disposed perpendicular to a longitudinal axis of the watercraft, the pivotable mounting mechanism comprising a movable swing arm; and (b) a spring mechanism comprising at least one spring, a portion of the swing arm of the pivotable mounting mechanism being pivotable against the spring;

wherein, when the motor is powered, the thrust of the motor automatically pushes the swing arm, which pushes in the spring, which changes position of the motor, lifting the stern, driving a bow of the watercraft down, and moving the watercraft into a planing position;

wherein the spring mechanism comprises two same-sized compression springs, which are substantially parallel to one another; and wherein a trim bracket comprises a substantially planar middle bracket section, which is mountable on the transom of the watercraft, and two matching side arms, which extend in a generally perpendicular direction from opposite sides of the middle bracket section.

7. A trim system according to claim 6, wherein the trim bracket further comprises mounting bolts extending through holes along the opposite sides of the middle bracket section into the transom.

8. A trim system according to claim 6, wherein the swing arm is generally T-shaped and comprises an upper, generally horizontal portion and a generally vertical swing arm bar, the swing arm bar being perpendicular to and below the upper portion and extending into the upper portion.

9. A trim system according to claim 8, wherein the swing arm further comprises a hole extending through an upper portion of the swing arm bar in a generally horizontal direction.

10. A trim system according to claim 9, wherein the pivotable mounting mechanism further comprises a swing arm bolt extending through the upper swing arm portion and through the swing arm hole, opposite ends of the swing arm bolt extending through corresponding holes in the bracket side arms, the opposite ends of the swing arm bolt being fastened so that the swing arm is swingable back and forth on the swing arm bolt.

11. A trim system according to claim 10, wherein the pivotable mounting mechanism further comprises two substantially same-sized connecting bars, which extend outwardly and in a generally perpendicular direction from the middle bracket section on either side of the swing arm bar.

12. A trim system according to claim 11, wherein the pivotable mounting mechanism further comprises a stop plate connected at its opposite ends to end portions of the connecting bars, a central portion of the stop plate extending around the swing arm bar.

13. A trim system according to claim 12, wherein the springs extend between the middle bracket section, and the swing arm bar, opposite ends of the springs being coiled around stops extending outwardly from the middle bracket section 48 and the swing arm bar.

14. A trim system according to claim 13, wherein opposite ends of the springs are coiled around stops, which extend outwardly from the middle bracket section and an inside face of the swing arm bar.

15. A method for enabling a outboard motor-driven watercraft having a propeller to attain and maintain a planing attitude, including the steps of:

(a) in a first position wherein the propeller provides no thrust, pre-loading two matching, parallel springs of a spring mechanism of a trim system, the springs extending between a lower portion of a swing arm and a middle bracket section of a trim bracket of the trim system, so as to bias the outboard motor in a forward direction, the lower portion of the swing arm being restrained by a stop plate, the middle bracket section being removably mounted on the transom of the watercraft; and (b) applying thrust to the outboard motor, creating a torque reaction on the watercraft; wherein the spring mechanism automatically causes the outboard motor to rotate forward about an axis of the trim system to a second position, attaining a planing position.

16. A method according to claim 15, wherein, in step (a), the springs of the spring mechanism are slidably restrained against the lower portion of the swing arm, opposite ends of the stop plate being affixed to connecting bars, the connecting bars extending in a generally perpendicular direction from the middle bracket section.

17. A method according to claim 15, wherein, in step (b), the springs of the spring mechanism are compressed between the lower portion of the swing arm and the middle bracket section.

* * * * *